US005228012A

United States Patent [19]

Seager

[11] Patent Number: 5,228,012

[45] Date of Patent: Jul. 13, 1993

[54] WRISTWATCH RADIOTELEPHONE

[75] Inventor: Richard H. Seager, Mystic, Conn.

[73] Assignee: Timex Corporation, Middlebury, Conn.

[21] Appl. No.: 961,652

[22] Filed: Oct. 16, 1992

[51] Int. Cl.[5] ..... G04B 47/00; A44C 5/00

[52] U.S. Cl. ..... 368/10; 368/282; 24/265 WS; 224/165; 379/436

[58] Field of Search ..... 368/10, 281–282; 24/265 WS; 224/164–165, 174; 379/90, 428, 430, 433

[56] References Cited

U.S. PATENT DOCUMENTS

| | | | |
|---|---|---|---|
| 2,120,438 | 6/1938 | Bezault | 224/164 |
| 3,032,651 | 5/1962 | Gisiger-Stahl et al. | 250/14 |
| 4,608,786 | 9/1986 | Omoto et al. | 224/164 |
| 4,817,064 | 3/1989 | Milles | 368/282 |
| 4,821,532 | 4/1989 | Jaques et al. | 24/265 WS |
| 4,847,818 | 7/1989 | Olsen | 368/10 |
| 5,008,864 | 4/1991 | Yashitake | 368/10 |
| 5,054,051 | 10/1991 | Hoff | 379/56 |
| 5,152,693 | 10/1992 | Matsui et al. | 24/265 WS |

*Primary Examiner*—Vit W. Miska
*Attorney, Agent, or Firm*—Robert R. Jackson

[57] ABSTRACT

A wristwatch radiotelephone has a plurality of arcuate members connected to one another in a series by rotatable connection mechanisms connected between adjacent members in the series. The connection mechanisms allow the arcuate members to be rotated relative to one another so that they either all curve in the same direction (thereby providing a nearly closed C-shaped structure suitable for being worn on the wrist as a wristwatch), or so that alternate members curve in opposite directions (thereby converting the apparatus to a more elongated form suitable for use as a hand-held radiotelephone).

12 Claims, 3 Drawing Sheets

FIG. 3
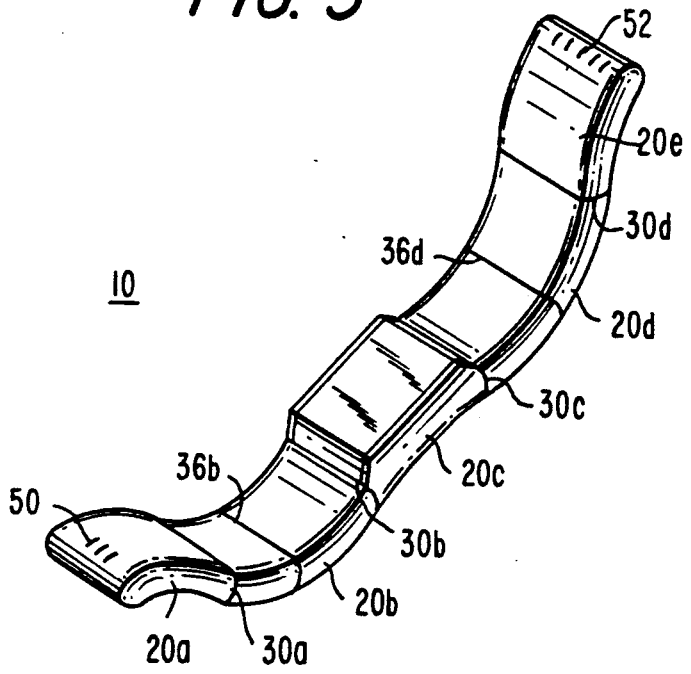
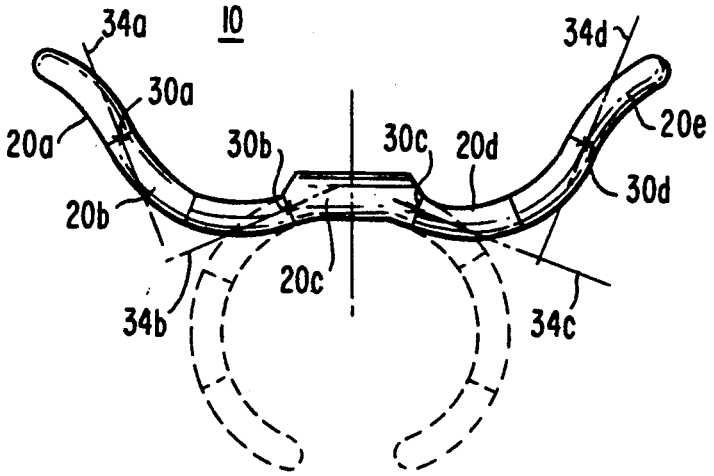
FIG. 4

WRISTWATCH RADIOTELEPHONE

BACKGROUND OF THE INVENTION

This invention relates to a combined wristwatch and radiotelephone, and more particularly to a wristwatch which can be converted temporarily to a form suitable for use as a hand-held radiotelephone.

Olsen U.S. Pat. No. 4,847,818 shows a wristwatch which can be removed from the user's wrist and temporarily reconfigured for use as a hand-held radiotelephone. The Olsen apparatus has many desirable features, but it would also be desirable to have a structure which formed a somewhat more definite, predetermined shape when reconfigured as a radiotelephone. This would tend to give the article a more substantial "feel" when used as a radiotelephone, thereby making the article more acceptable and attractive to at least some users.

In view of the foregoing, it is an object of this invention to provide a wristwatch radiotelephone which can be made to positively assume a definite shape of a first kind when configured for use as a wristwatch, and which can similarly be made to positively assume a definite shape of a second kind when configured for use as a radiotelephone.

It is a more particular object of this invention to provide a wristwatch radiotelephone which can be made to positively assume a predetermined substantially annular or nearly closed C shape when configured for use as a wristwatch, and which can be made to positively assume a predetermined elongated shape when configured for use as a radiotelephone.

SUMMARY OF THE INVENTION

These and other objects of the invention are accomplished in accordance with the principles of the invention by providing a wristwatch radiotelephone comprising at least five arcuate members disposed end to end in a series. The adjacent ends of each adjacent pair of these arcuate members are connected together by a connection mechanism. Each connection mechanism allows the arcuate members connected by that mechanism to rotate relative to one another about an axis which passes through the connection mechanism and adjacent portions of the associated arcuate members parallel to a plane intercepted by all of the arcuate members when the apparatus has the substantially annular or nearly closed C shape of a wristwatch. The rotation about each of these axes permits the associated arcuate members to rotate between a position in which the associated arcuate members curve in the same direction and a position in which the associated arcuate members curve in opposite directions. When all of the arcuate members curve in the same direction, the apparatus has the substantially annular or closed C shape of a wristwatch. When adjacent arcuate members curve in opposite directions, the apparatus has a more elongated shape suitable for use as a radiotelephone.

Each of the above-mentioned connection mechanisms preferably limits rotation about the associated axis to approximately 180° so that excessive rotation which could damage radiotelephone circuits passing through the connection mechanisms is prevented. If desired, each connection mechanism may be provided with a detent adjacent each end of the 180° rotational range of motion so that the apparatus tends to remain in either the curved wristwatch configuration or the more elongated radiotelephone configuration.

Further features of the invention, its nature and various advantages will be more apparent from the accompanying drawings and the following detailed description of the preferred embodiments.

BRIEF DESCRIPTION OF THE DRAWINGS

FIG. 3 is a simplified perspective view of the apparatus of FIG. 1 opened out to the radiotelephone configuration. The control buttons and display shown in FIG. 1 are omitted from FIG. 3.

FIG. 4 is a simplified elevational view of the apparatus of FIG. 3. Again, the control buttons shown in FIG. 1 are omitted from FIG. 4.

DETAILED DESCRIPTION OF THE PREFERRED EMBODIMENTS

Olsen U.S. Pat. No. 4,847,818, which is hereby incorporated by reference herein, shows all of the electronic components and circuitry needed for a wristwatch radiotelephone. All of those same components and circuitry can be used in a wristwatch radiotelephone constructed in accordance with the present invention. Accordingly, it will not be necessary to repeat here any of the details regarding that portion of the apparatus.

Figure 1:
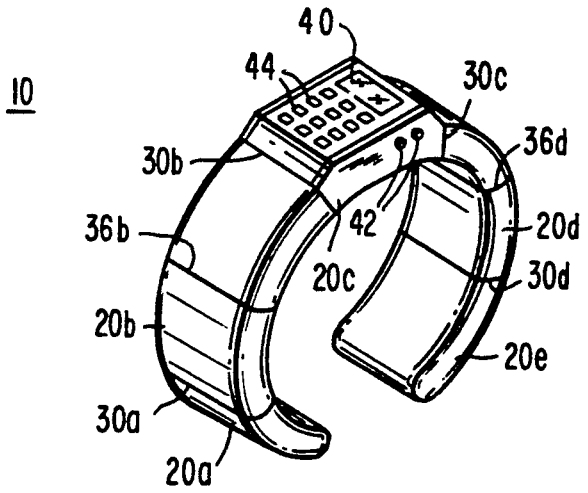
FIG. 1 is a simplified perspective view of an illustrative embodiment of a wristwatch radiotelephone constructed in accordance with the principles of this invention in the wristwatch configuration.
Figure 2:
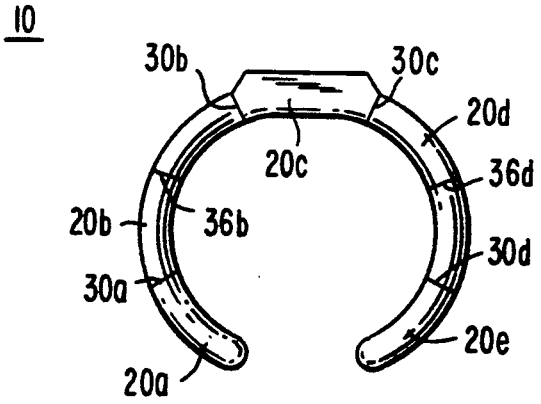
FIG. 2 is a simplified elevational view of the apparatus of FIG. 1. The control buttons shown in FIG. 1 are omitted from FIG. 2.
Figure 5:
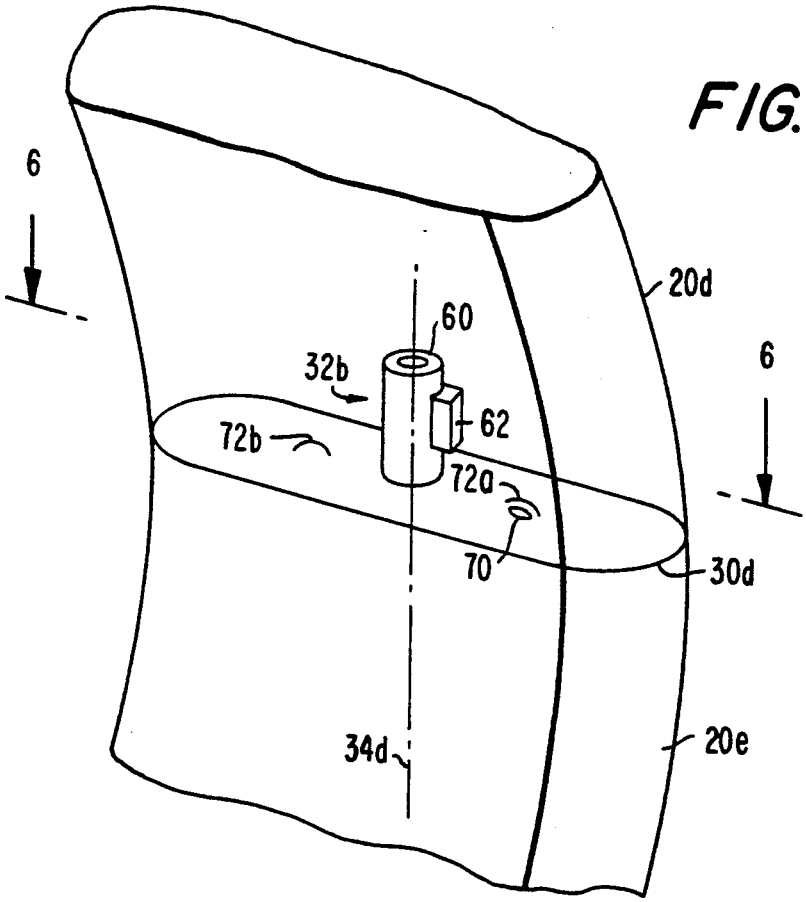
FIG. 5 is an enlarged and simplified perspective view of a portion of the apparatus of FIGS. 1–4. Certain parts of the apparatus shown in FIG. 5 are shown as though transparent in order to reveal the interior construction of the apparatus.

As shown in FIG. 1, an illustrative preferred embodiment of a wristwatch radiotelephone 10 constructed in accordance with this invention includes a plurality of substantially rigid, arcuate segments or members 20*a–e* connected together end to end at interfaces 30*a–d*. As is illustrated by FIG. 5 which shows one representative connection mechanism 32*d*, at each interface 30 the adjacent abutting members 20 are held together by a rotatable connection mechanism 32. Each connection mechanism 32 is centrally located in the associated interface region 30 and allows relative rotation of the associated abutting members 20 about an associated axis 34 which passes through the connection mechanism and adjacent portions of the associated abutting members 20 parallel to a plane intercepted by all of members 20 when the apparatus is in the curved wristwatch form shown in FIGS. 1 and 2. The above-mentioned plane is perpendicular to the longitudinal axis of the user's wrist when the apparatus is being worn as a wristwatch (i.e., the above-mentioned plane is parallel to the plane of the paper on which FIG. 2 is drawn). In the depicted preferred embodiment the plane defined by each of interfaces 30 is substantially radial to the user's wrist when the apparatus is being worn as a wristwatch. Each axis 34 is perpendicular to the associated interface plane. Therefore, in the depicted preferred embodiment, each axis 34 is approximately tangent to the circumference of the user's wrist when the apparatus is being worn as a wristwatch.

When arranged as shown in FIGS. 1 and 2, arcuate members 20 form a nearly closed C shape having size and shape suitable for wearing on the wrist. Although these components could alternatively be included on any member or members 20, in the depicted preferred embodiment member 20*c* includes a display 40, timepiece and telephone control buttons 42, and telephone dialing buttons 44 (respectively similar to elements 10–12 in the above-mentioned Olsen patent). When members 20 are arranged as shown in FIGS. 1 and 2, the inner surfaces of members 20 define a generally elliptical shape which conforms to the elliptical shape of the human wrist. If desired, a releasable clasp could be provided to link the ends of members 20*a* and 20*e* which are shown as free in FIGS. 1 and 2.

When apparatus 10 is removed from the wrist, connections 32 allow members 20 to be rearranged from the C-shaped arrangement shown in FIGS. 1 and 2 to the more elongated arrangement shown in FIGS. 3 and 4. To rearrange members 20 in this way, member 20*b* is rotated 180° relative to member 20*c* about the axis 34*b* which is perpendicular to the plane defined by the interface 30*b* between members 20*b* and 20*c*. A mechanical connection (like depicted connection 32*d*) permits this rotation about axis 34*b*. As a result of this relative rotation of members 20*b* and 20*c*, these two members, which formerly curved in the same direction, now curve in opposite directions. Member 20*d* is similarly rotated 180° relative to member 20*c* so that members 20*c* and 20*d* also now curve in opposite directions rather than in the same direction.

In addition to the above-described rotations at interfaces 30*b* and 30*c*, member 20*a* is rotated 180° relative to member 20*b* about the axis 34*a* which is perpendicular to the plane defined by interface 30*a*. Again, a mechanical connection (like depicted connection 32*d*) permits this rotation about axis 34*a*. As a result of this relative rotation of members 20*a* and 20*b*, these two members, which formerly curved in the same direction, now curve in opposite directions. Member 20*e* is similarly rotated 180° relative to member 20*d* so that members 20*d* and 20*e* also now curve in opposite directions.

When each of members 20 has been rotated 180° relative to the adjacent member or members as described above, apparatus 10 has the elongated shape shown in FIGS. 4 and 5. In this condition the apparatus is suitable for use as a hand-held radiotelephone. In particular, the apparatus can be held alongside the user's face so that a microphone 50 in member 20*a* is adjacent the user's mouth, while a speaker 52 in member 20*e* is adjacent the user's ear.

After the apparatus has been used as a radiotelephone, it can be returned to its wristwatch configuration (FIGS. 1 and 2) by reversing the above-described operations which placed it in the radiotelephone configuration. Although rotations at interfaces 30 are described above in a particular sequence, it will be understood that these rotations can be performed in any order when converting the apparatus in either direction between the wristwatch and radiotelephone configurations.

Figure 6:
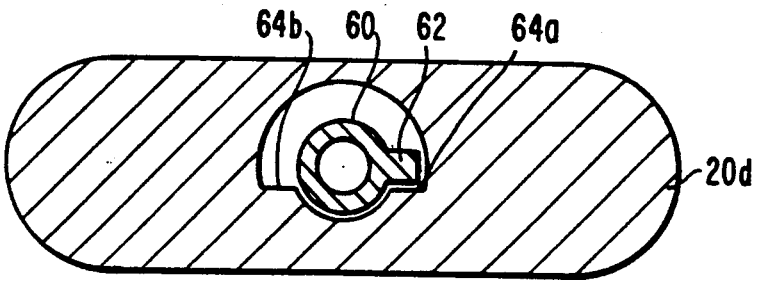
FIG. 6 is a sectional view taken along the line 6—6 in FIG. 5.

The 180° rotatable connections in the present apparatus can be generally similar to the 180° rotatable connections shown in commonly assigned, concurrently filed patent applications Ser. No. 07/961,656 and Ser. No. 07/961,655, both of which are hereby incorporated by reference herein. Other, somewhat analogous connections are shown in commonly assigned, concurrently filed application Ser. No. 07/961,353, which is also hereby incorporated by reference herein. Although other constructions of such connection mechanisms are possible, FIGS. 5 and 6 illustrate a suitable construction of one representative connection. In this construction substantially cylindrical pin 60 extends from one end of member 20*e* into a substantially cylindrical socket in member 20*d*. Pin 60 is fixed to member 20*e* and is concentric with axis 34*d*. Pin 60 is rotatable in the above-mentioned socket in member 20*d*. Pin 60 may be made hollow to provide a passageway for electrical connections extending between members 20.

A key 62 extends from a portion of one side of pin 60. Key 62 holds members 20*d* and 20*e* together. Alternatively or in addition, a prestressed tension elastomeric band or other similar element may pass through the passageway in pin 60 between members 20 to hold adjacent members 20 together. Key 62 also cooperates with stop surfaces 64*a* and 64*b* in member 20*d* to limit relative rotation of members 20*d* and 20*e* to approximately 180° about axis 34*d*. Limiting the amount of rotation in this way prevents excessive relative rotation of members 20 which could damage electrical circuits passing through the connection mechanisms between the radiotelephone components of the apparatus.

A spring-biased ball 70 projects part way out of the surface of member 20*e* which is adjacent member 20*d*. The outwardly projecting surface of this ball is releasably receivable in either of two recesses 72*a* and 72*b* formed in the surface of member 20*d* which is adjacent member 20*e*. Recesses 72*a* and 72*b* are spaced from one another by 180° about axis 34*d*. Accordingly, ball 70 cooperates with recesses 72 to provide detents for releasably holding members 20*d* and 20*e* in either the relative positions in which both members curve in the same direction or the relative positions in which the members curve in opposite directions.

Because in the depicted preferred embodiment each connection mechanism 32 is centrally located in the associated interface region 30 and the perimeter of the interface is symmetrical about the axis of rotation 34 of the connection mechanism, the exterior surface of apparatus 10 is substantially smooth whether the apparatus is in the wristwatch or the radiotelephone configuration. Indicia 36*b* and 36*d* are provided in members 20*b* and 20*d* to resemble interfaces 30, but they are not in fact interfaces at which rotation can occur. Indicia 36 are merely provided to give apparatus 10 a more regular appearance along its length.

It will be understood that the foregoing is merely illustrative of the principles of this invention, and that various modifications can be made by those skilled in the art without departing from the scope and spirit of the invention. For example, although the depicted embodiment includes five members 20, it will be understood that a larger number of members can be used if desired. As another example of modifications within the scope of the invention, elements 40, 42, 44, 50, and 52 can be placed in any desired locations on the apparatus.

The invention claimed is:

1. Apparatus which is convertible between a curved shape adapted for wearing around the wrist as a wristwatch and an elongated shape in which said apparatus is suitable for use as a hand-held radiotelephone with a microphone and a speaker adjacent respective opposite ends of said elongated shape comprising:

first, second, third, fourth, and fifth arcuate members disposed end to end in a series; and a plurality of connection mechanisms, each of which connects the adjacent ends of a respective one of adjacent pairs of said arcuate members in said series, each of said connection mechanisms allowing the arcuate members connected by the connection mechanism to rotate relative to one another about an associated axis which passes through the connection mechanism and adjacent portions of the arcuate members connected by the connection mechanism parallel to a plane intercepted by all of said arcuate members when said apparatus has said curved shape, the rotation about each of said axes being between a first relative rotational position in which the associated arcuate members curve in the same direction and a second relative rotational position in which the associated arcuate members curve in opposite directions.

2. The apparatus defined in claim 1 wherein the adjacent ends of said arcuate members which are connected by each of said connection mechanisms are substantially radial to the wrist when said apparatus is worn on the wrist in the curved wristwatch shape.

3. The apparatus defined in claim 2 wherein said axis associated with each of said connection mechanisms is substantially perpendicular to the adjacent ends of said arcuate members which are connected by said connection mechanism.

4. The apparatus defined in claim 3 wherein the adjacent ends of said arcuate members which are connected by each of said connection mechanisms have perimeters of substantially the same shape.

5. The apparatus defined in claim 4 wherein said axis associated with each of said connection mechanisms is centrally located within the perimeters of the adjacent ends of said arcuate members which are connected by said connection mechanism.

6. The apparatus defined in claim 5 wherein the perimeters of the adjacent ends of said arcuate members which are connected by each of said connection mechanisms are substantially symmetrical about said axis associated with said connection mechanism.

7. The apparatus defined in claim 1 wherein each of said connection mechanisms allows the arcuate members which are connected by said connection mechanism to rotate approximately 180° relative to one another about said axis associated with said connection mechanism.

8. The apparatus defined in claim 7 wherein each of said connection mechanisms allows the arcuate members which are connected by said connection mechanism to rotate no more than approximately 180° relative to one another about said axis associated with said connection mechanism.

9. The apparatus defined in claim 1 wherein said microphone is disposed in said first arcuate segment and said speaker is disposed in said fifth arcuate segment.

10. The apparatus defined in claim 1 further comprising:

a radiotelephone dialing keypad disposed in said third arcuate member.

11. The apparatus defined in claim 1 further comprising:

a wristwatch display element disposed in said third arcuate member.

12. The apparatus defined in claim 1 further comprising:

wristwatch control buttons disposed in said third arcuate member.

* * * * *